US009379459B2

(12) United States Patent
Grzywok

(10) Patent No.: US 9,379,459 B2
(45) Date of Patent: Jun. 28, 2016

(54) ELECTRICAL CONNECTOR

(71) Applicant: Tyco Electronics AMP GmbH, Bensheim (DE)

(72) Inventor: Wilhelm Grzywok, Munich (DE)

(73) Assignee: TE Connectivity Germany GmbH, Bensheim (DE)

( * ) Notice: Subject to any disclaimer, the term of this patent is extended or adjusted under 35 U.S.C. 154(b) by 177 days.

(21) Appl. No.: 14/181,596

(22) Filed: Feb. 14, 2014

(65) Prior Publication Data

US 2014/0235115 A1 Aug. 21, 2014

(30) Foreign Application Priority Data

Feb. 15, 2013 (DE) ..... 10 2013 202 513

(51) Int. Cl.

| | |
|---|---|
| ***H01R 31/08*** | (2006.01) |
| ***H01R 4/16*** | (2006.01) |
| ***H01R 43/04*** | (2006.01) |
| ***H01R 13/11*** | (2006.01) |
| ***H01R 43/16*** | (2006.01) |

(52) U.S. Cl.

CPC ..... *H01R 4/16* (2013.01); *H01R 13/113* (2013.01); *H01R 43/04* (2013.01); *H01R 43/16* (2013.01); *Y10T 29/49218* (2015.01)

(58) Field of Classification Search

USPC ..... 439/510, 511, 512, 513

See application file for complete search history.

(56) References Cited

U.S. PATENT DOCUMENTS

| | | | | | |
|---|---|---|---|---|---|
| 3,706,955 | A * | 12/1972 | Bunnell | H01B 7/0009 | 174/126.1 |
| 3,932,013 | A * | 1/1976 | Yeager | H01R 13/114 | 439/510 |
| 4,029,376 | A * | 6/1977 | Headington | H01R 31/02 | 439/510 |
| 4,845,589 | A * | 7/1989 | Weidler | H01R 25/162 | 200/51 R |
| 5,997,347 | A * | 12/1999 | Robinson | H01R 13/426 | 439/517 |
| 6,102,754 | A * | 8/2000 | Capper | H01R 13/113 | 439/517 |
| 7,677,934 | B2 * | 3/2010 | Piovesan | H01R 13/112 | 439/818 |
| 7,892,050 | B2 * | 2/2011 | Pavlovic | H01R 9/245 | 439/250 |
| 8,182,299 | B2 * | 5/2012 | Schrader | H01R 13/113 | 439/839 |
| 9,070,990 | B2 * | 6/2015 | Flickinger | H01R 4/48 | |
| 2006/0270277 | A1 | 11/2006 | Zhao et al. | | |

* cited by examiner

*Primary Examiner* — Neil Abrams

(74) *Attorney, Agent, or Firm* — Faegre Baker Daniels LLP

(57) ABSTRACT

An electrical connector comprises a first single-piece contact bracket, a second single-piece contact bracket and a flat, flexible, electrically conductive strip. The first contact bracket and the second contact bracket are secured to the strip with spacing.

15 Claims, 4 Drawing Sheets

ELECTRICAL CONNECTOR

RELATED APPLICATION

This application claims priority to German Patent Application Serial Number DE102013202513.0 filed on Feb. 15, 2013; the subject matter of which is incorporated herein by reference.

BACKGROUND

The present invention relates to an electrical connector.

Numerous variants of electrical connectors for producing electrically conductive connections between components are known from the prior art. In particular, there are also known electrical connectors which are provided to connect battery modules or battery cells and which are configured to guide high electrical currents. Such electrical connectors are used, for example, in electric motor vehicles.

US 2006/0270277 A1 describes an electrical connector which has two contact elements which are connected to each other by means of a metal sheet. Compensation for tolerances in the spacing of the components to be connected is only possible to a limited extent with this electrical connector.

SUMMARY

An object of the present invention is to provide an electrical connector. This object is achieved with an electrical connector having the features of claim 1. Another object of the present invention is to set out a method for producing an electrical connector. This object is achieved with a method having the features of claim 13. Various developments are set out in the dependent claims.

An electrical connector comprises a first single-piece contact bracket, a second single-piece contact bracket and a flat, flexible, electrically conductive strip. The first contact bracket and the second contact bracket are secured to the strip with spacing. Advantageously, this electrical connector is generally constructed in one piece, whereby, during production, delivery and assembly of the electrical connector, there is no risk of components of the electrical connector becoming lost. The single-piece construction of the electrical connector advantageously also facilitates the assembly of the electrical connector. Owing to the flexible strip of the electrical connector, a spacing between the first contact bracket and the second contact bracket can be readily changed over a wide range, whereby the electrical connector advantageously enables simple compensation for even large tolerances.

In an embodiment of the electrical connector, the first and/or the second contact bracket has/have a clamping region for receiving a contact blade. Advantageously, this enables simple contacting of the first contact bracket of the electrical connector by a contact blade of a component which is intended to be electrically contacted being pushed into the clamping region of the first contact bracket. Advantageously, the contact blade is retained in the clamping region of the first contact bracket in a clamping manner, whereby inadvertent disengagement of the electrical connector from the component to be contacted is made more difficult.

In an embodiment of the electrical connector, the first and/or second contact bracket is/are constructed in such a manner that a contact blade can be introduced into the clamping region parallel with a flat side of the strip. Advantageously, the electrical connector thereby has compact outer dimensions.

In an embodiment of the electrical connector, the first and/or second contact bracket is/are constructed in such a manner that a contact blade can be introduced into the clamping region perpendicularly relative to a longitudinal extent direction of the strip. Advantageously, the electrical connector can thereby be fitted in a simple manner to two components to be connected.

In an embodiment of the electrical connector, the first and/or the second contact bracket has/have a plurality of inner resilient bars and a plurality of outer resilient bars which are arranged on a common strut. In this instance, the clamping region is formed between the inner resilient bars and the outer resilient bars. Advantageously, the inner resilient bars and the outer resilient bars apply a clamping force to a contact blade which is introduced into the clamping region, whereby the contact blade is retained in the clamping region.

In an embodiment of the electrical connector, the first and/or the second contact bracket has/have a securing plate. In this instance, the securing plate is secured to the strip. Advantageously, a mechanically robust and electrically highly conductive connection is thereby produced between the first and/or second contact bracket and the strip.

In an embodiment of the electrical connector, the strut adjoins the securing plate. In this instance, the first and/or second contact bracket is/are angled in the region of the strut in such a manner that the clamping region is arranged above the securing plate and is orientated substantially parallel with the securing plate. Advantageously, the first and/or second contact bracket can thereby be produced in a simple and cost-effective manner and has/have compact outer dimensions.

In an embodiment of the electrical connector, the first contact bracket and the second contact bracket are secured to the strip by means of welding, soldering, stapling or riveting. Advantageously, connections which can be produced in a simple and cost-effective manner and which are electrically highly conductive and mechanically robust are thereby produced between the contact brackets and the strip.

In an embodiment of the electrical connector, the first and/or second contact bracket has/have a first wing and a second wing. In this instance, the securing plate is arranged between the first wing and the second wing. The first wing and the second wing are each angled through approximately 90° with respect to the securing plate. The first wing has a first catch projection. The second wing has a second catch projection. Two inner resilient bars of the first and/or second contact bracket are engaged on the catch projections. Advantageously, the strut of the first and/or second contact bracket is thereby fixed in the bent end position thereof and the clamping region of the first and/or second contact bracket is retained in the position thereof arranged above the securing plate.

In an embodiment of the electrical connector, the strip comprises a metal braiding strip, a plurality of parallel layers of thin metal and/or a plurality of metal strips or wires which are arranged beside each other. Advantageously, the strip can thereby be obtained in a cost-effective manner, is mechanically flexible and has good electrical conductivity.

In an embodiment of the electrical connector, the first contact bracket and the second contact bracket are secured to a flat side of the strip. Advantageously, a compact structural shape of the electrical connector is thereby produced.

In an embodiment of the electrical connector, the first contact bracket and the second contact bracket are constructed in an identical manner. Advantageously, the electrical connector thereby has only a small number of different parts, whereby the electrical connector can be produced in a particularly cost-effective manner.

A method for producing an electrical connector comprises steps of producing a first contact bracket having a securing plate and a plurality of inner resilient bars and a plurality of outer resilient bars by means of punching, the inner resilient bars and the outer resilient bars being connected to the securing plate by means of a strut, a clamping region being formed between the inner resilient bars and the outer resilient bars, for securing the first contact bracket and a similar second contact bracket to a flat, flexible, electrically conductive strip and for bending the strut of the first contact bracket in such a manner that the clamping region is arranged over the securing plate and is orientated substantially parallel with the securing plate. Advantageously, the method allows cost-effective production of an electrical connector. The electrical connector which can be obtained using the method advantageously enables compensation for large tolerances in the spacing between components which are intended to be connected to each other in an electrical manner. The electrical connector which can be obtained using the method is advantageously constructed in one piece, whereby production, transport and assembly of the electrical connector are simplified and a danger of a loss of components of the electrical connector is eliminated.

In an embodiment of the method, the strut is bent with respect to the securing plate through a first angle before the first contact bracket is secured. After the first contact bracket has been secured, the strut is bent further until the clamping region has reached the end position thereof. Advantageously, the securing plate of the first contact bracket is still accessible after the strut has been bent through the first angle, whereby the securing of the first contact bracket to the strip is facilitated.

In an embodiment of the method, the first contact bracket is produced with a first wing and a second wing which are arranged at mutually opposing sides of the securing plate. In this instance, a first catch projection is constructed on the first wing and a second catch projection is constructed on the second wing. The first wing and the second wing are each angled through approximately 90° with respect to the securing plate. Two inner resilient bars of the first contact bracket are engaged on the catch projections. Advantageously, the production of the first contact bracket is thereby further simplified. The strut can be bent in a simple manner until the two inner resilient bars engage on the catch projections of the wings of the first contact bracket. The clamping region of the first contact bracket is then located automatically in the desired end position thereof and retains this position owing to the engagement.

BRIEF DESCRIPTION OF THE DRAWINGS

The invention is explained in greater detail below with reference to Figures, in which.

DETAILED DESCRIPTION

Figure 1:
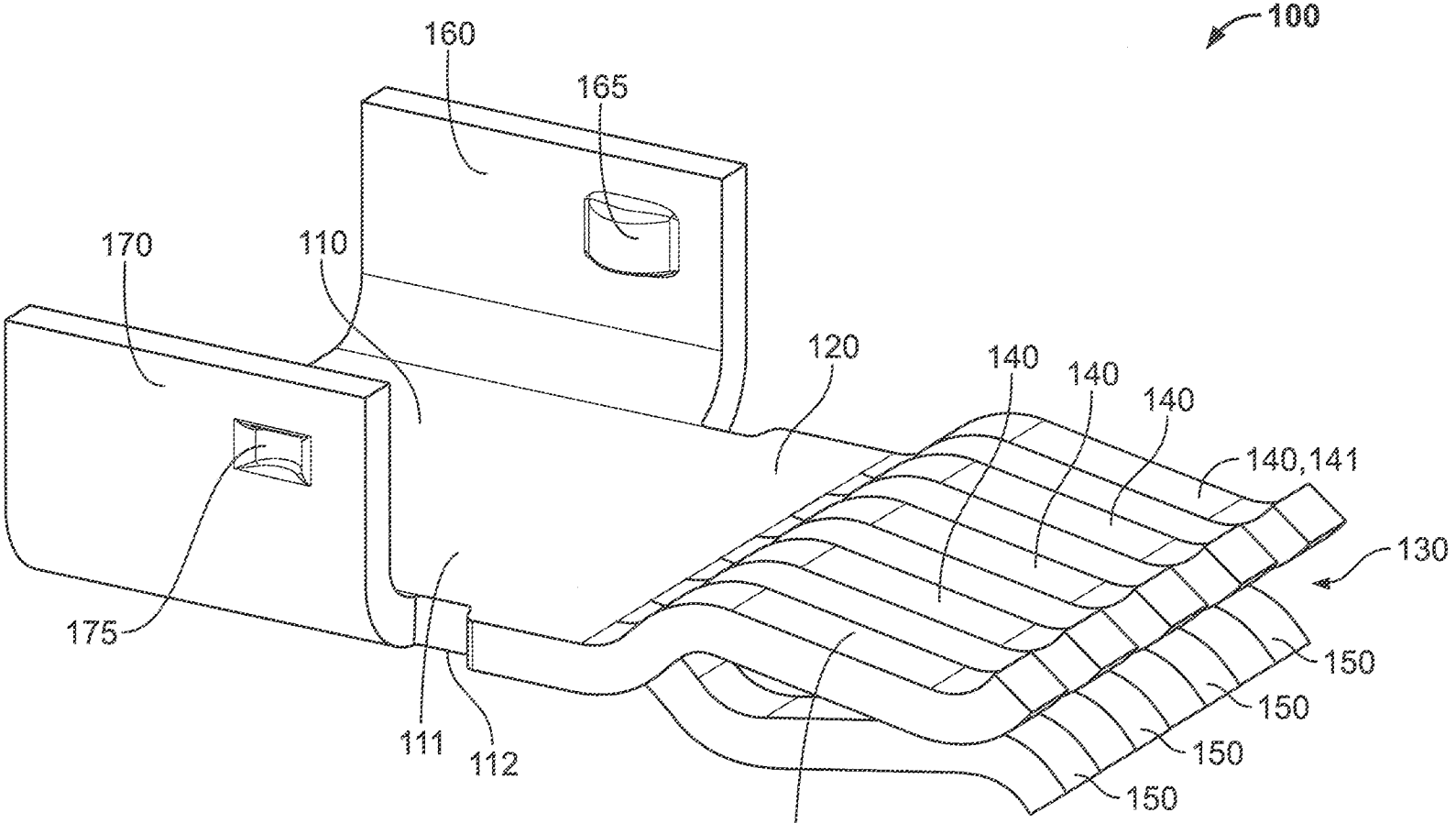
FIG. 1 is a perspective view of a first contact bracket in a first processing state.

FIG. 1 is a perspective view of a first contact bracket 100 in a still-incomplete processing state. The first contact bracket 100 has an electrically conductive material, preferably a metal. The first contact bracket 100 may, for example, have a copper/nickel/silicon alloy or a copper/beryllium alloy. The first contact bracket 100 may be produced by means of punching and deformation from a thin metal sheet. Punching and deformation may be carried out in a common operating step or in separate operating steps. The metal sheet may, for example, have a thickness of 1.5 mm.

The first contact bracket 100 comprises a securing plate 110 which is constructed as a substantially planar and approximately rectangular plate. Two mutually opposed outer sides of the securing plate 110 are adjoined by a first wing 160 and a second wing 170 of the first contact bracket 100. A third outer side of the securing plate 110 is adjoined by a strut 120. A plurality of inner resilient bars 140 and a plurality of outer resilient bars 150 of the first contact bracket 100 are arranged on the strut 120. All the components of the contact bracket 100 are constructed so as to be coherent in a materially uniform manner. The first contact bracket 100 is consequently constructed in an integral manner.

The first wing 160 and the second wing 170 are formed from rectangular sheet metal portions, respectively, which adjoin two mutually opposing sides of the securing plate 110. The first wing 160 and the second wing 170 are each angled through approximately 90° with respect to the securing plate 110. The first wing 160 and the second wing 170 are in this instance directed in the same spatial direction from the securing plate 110. Together, the first wing 160, the securing plate 110 and the second wing 170 consequently have a U-shaped profile.

A surface of the securing plate 110 which is directed in the same spatial direction as the first wing 160 and the second wing 170 forms an inner side 111 of the securing plate 110. A surface of the securing plate 110 facing the inner side 111 forms an outer side 112 of the securing plate 110.

The first wing 160 has a first catch projection 165. The second wing 160 has a second catch projection 175. The first catch projection 165 and the second catch projection 175 are each directed into the spatial region surrounded by the wings 160, 170 and the inner side 111 of the securing plate 110.

The strut 120 of the first contact brackets 100 is formed by means of a substantially rectangular sheet metal portion of the first contact bracket 100 which adjoins the securing plate 110 at a third outer side of the securing plate 110.

The strut 120 is in turn adjoined by the inner resilient bars 140 and the outer resilient bars 150 which face away from the securing plate 110. The inner resilient bars 140 and the outer resilient bars 150 are constructed as teeth which extend perpendicularly on the strut 120. Inner resilient bars 140 and outer resilient bars 150 alternate with each other. A first inner resilient bar 141 and a second inner resilient bar 142 are formed in the edge regions at both sides. In the example illustrated, the first contact bracket 100 has a total of five inner resilient bars 140, between which four outer resilient bars 150 are arranged. The first contact bracket 110 could, however, also have a different number of inner resilient bars 140 and outer resilient bars 150.

The inner resilient bars 140 are bent slightly in the spatial direction in which the inner side 111 of the securing plate 110 faces. The outer resilient bars 150 are bent slightly in the spatial direction in which the outer side 112 of the securing plate 110 faces. A clamping region 130 is thereby formed between the inner resilient bars 140 and the outer resilient bars 150. A flat metal sheet can be introduced into the clamping region 130, the inner resilient bars 140 and the outer resilient bars 150 being slightly deformed resiliently. The inner resilient bars 140 and the outer resilient bars 150 then apply a resilient force to the metal sheet introduced into the clamping region 130, whereby it is retained in the clamping region 130. In the processing state of the first contact bracket 100 illustrated in FIG. 1, the clamping region 130 is orientated parallel with the securing plate 110 and arranged laterally beside the securing plate 110. The securing plate 110 and the clamping region 130 are located approximately in a common plane.

Figure 2:
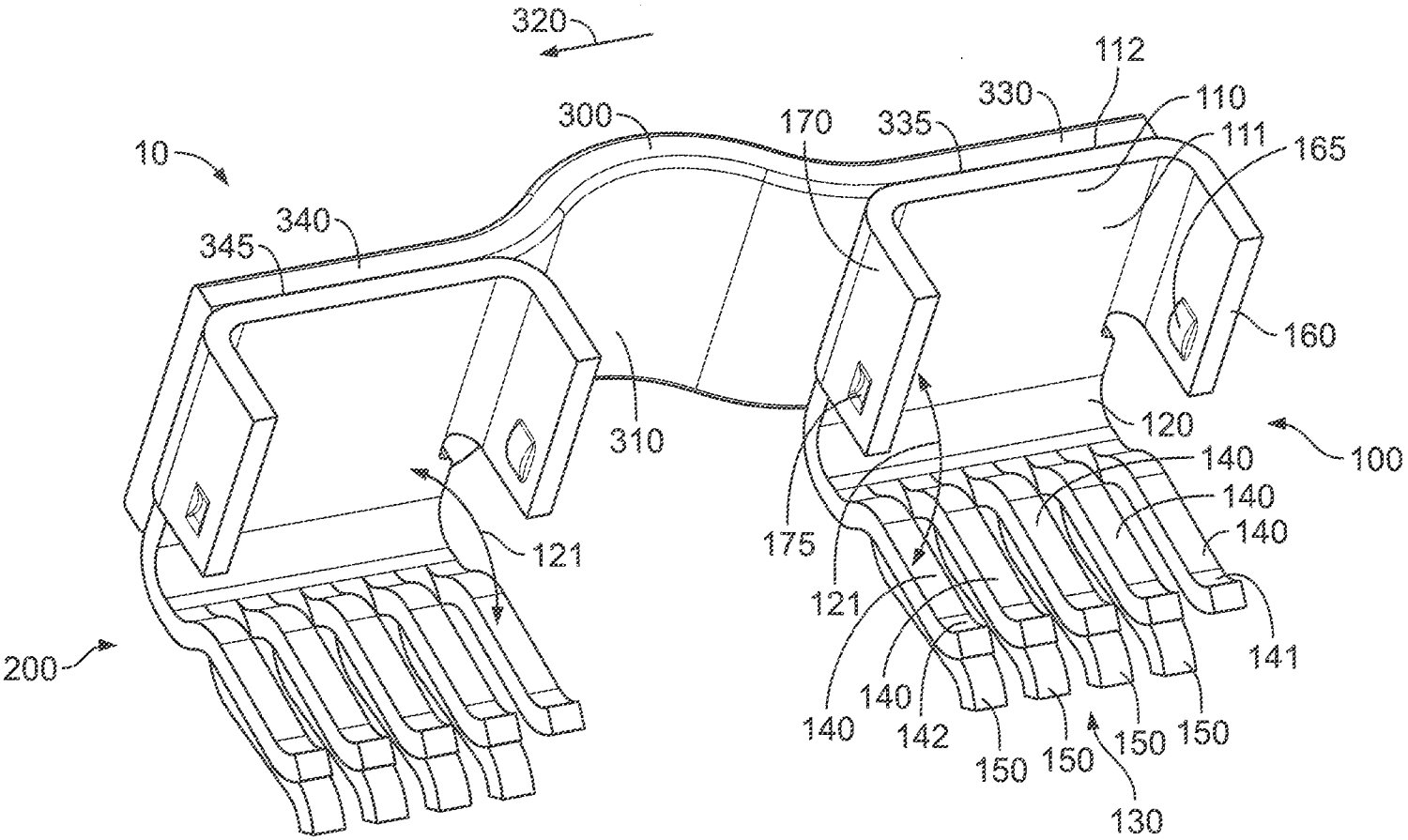
FIG. 2 is a perspective view of an electrical connector in an incomplete processing state.

FIG. 2 is a perspective view of an electrical connector 10 in a still-incomplete processing state. The electrical connector 10 comprises a strip 300, the first contact bracket 100 shown in FIG. 1 and a second contact bracket 200 which is identical to the first contact bracket 100.

The strip 300 is constructed as a flexible, flat and electrically conductive strip having a flat side 310. The strip extends in a longitudinal extent direction 320. The strip 300 may, for example, be constructed as a metal braiding strip. The strip 300 may also have a plurality of parallel layers of thin metal and/or a plurality of metal strips or wires which are arranged beside each other. The strip 300 may, for example, have copper.

The first contact bracket 100 and the second contact bracket 200 are secured to the flat side 310 of the strip 300. The first contact bracket 100 is arranged at a first longitudinal end 330 of the metal braiding strip 300. The second contact bracket 200 is arranged at a second longitudinal end 340 of the metal braiding strip 300. In the longitudinal extent direction 320, the strip 300 may, for example, have a length of 30 cm between a centre of the first contact bracket 100 and a centre of the second contact bracket 200. The first contact bracket 100 and the second contact bracket 200 may be secured to the flat side 310 of the strip 300, for example, by means of welding, soldering, stapling or riveting. It is also possible for the first contact bracket 100 and the second contact bracket 200 to be connected to the strip 300 in each case by means of an additional flap.

The outer sides 112 of the securing plates 110 of the first contact bracket 100 and the second contact bracket 200 each face the flat side 310 of the strip 300. There is a first connection 335 between the outer side 112 of the securing plate 110 of the first contact bracket 100 and the flat side 310 of the strip 300. There is a second connection 345 between the outer side 112 of the securing plate 110 of the second contact bracket 200 and the flat side 310 of the strip 200. The connections 335, 345 may, for example, be weld connections which have been produced by means of ultrasound or resistance welding. The connections 335, 345 form mechanically robust connections with good electrical conductivity between the contact brackets 100, 200 and the strip 300.

The first contact bracket 100 is arranged on the flat side 310 of the strip 300 in such a manner that the first wing 160 and the second wing 170 of the first contact bracket 100 are located one behind the other in the longitudinal extent direction 320 of the metal braiding 300. The strut 120 is orientated parallel with the longitudinal extent direction 320 of the strip 300. The inner resilient bars 140 and the outer resilient bars 150 of the first contact bracket 100 are orientated perpendicularly relative to the longitudinal extent direction 320. The second contact bracket 200 is also orientated in such a manner that the first wing 160 and the second wing 170 of the second contact bracket 200 are arranged one behind the other in the longitudinal extent direction 320 of the strip 300.

With respect to the processing state of the first contact bracket 100 illustrated in FIG. 1, in the processing state shown in FIG. 2 the strut 120 of the first contact bracket 100 has been bent forwards through a forward bending angle 121. The forward bending angle 121 is approximately 90°. The strut 120 is bent through the forward bending angle 121 in such a manner that the inner resilient bars 140 and the outer resilient bars 150 of the first contact bracket 100 extending from the strut 120 are orientated substantially perpendicularly relative to the securing plate 110 of the first contact bracket 100 and are directed in the spatial direction in which the inner side 111 of the securing plate 110 of the first contact bracket 100 is also directed. The strut 120 of the second contact bracket 200 is also bent forwards through the forward bending angle 121.

The forward bending of the strut 120 of the first contact bracket 100 and the strut 120 of the second contact bracket 200 may have been carried out in a common operating step with the punching of the first contact bracket 100 and the second contact bracket 200 and/or in a common operating step with the bending of the wings 160, 170 and the bending of the inner resilient bars 140 and the outer resilient bars 150 of the first contact bracket 100 and the second contact bracket 200.

In the processing state of the first contact bracket 100 and the second contact bracket 200 illustrated in FIG. 2 with the struts 120 bent forwards through the forward bending angle 121, the inner sides 111 of the securing plates 110 of the contact brackets 100, 200 are accessible. Whilst the contact brackets 100, 200 are secured to the flat side 310 of the strip 200, a tool may have been engaged with the inner sides 111 of the securing plates 110 of the contact brackets 100, 200.

Figure 3:
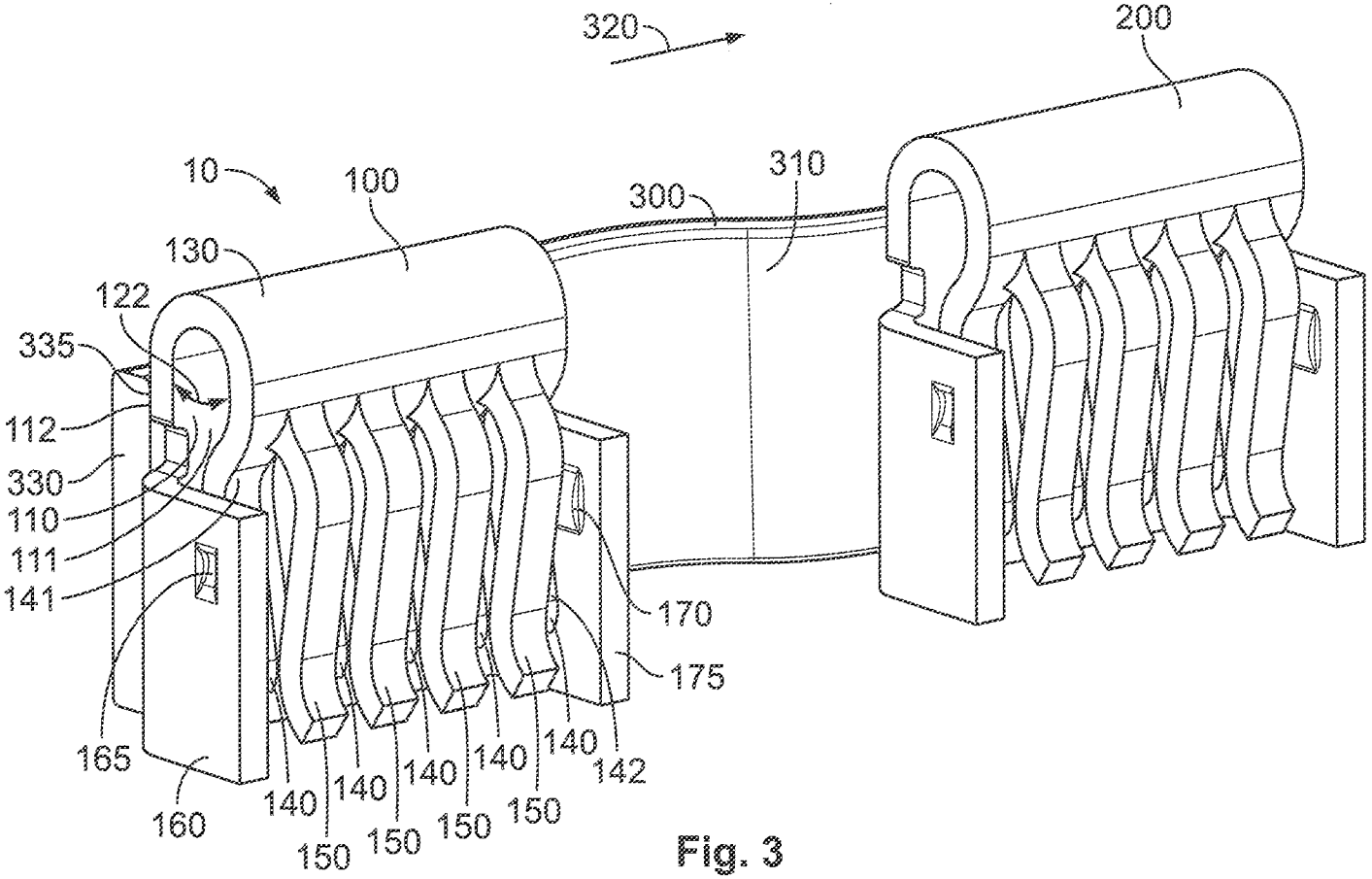
FIG. 3 is a perspective view of the electrical connector in a complete processing state.

FIG. 3 is another perspective view of the electrical connector 10. FIG. 3 shows the electrical connector 10 in a completed processing state. With respect to the processing state illustrated in FIG. 2, the strut 120 of the first contact bracket 100 has been bent further. In this instance, the inner resilient bars 140 and the outer resilient bars 150 have been moved towards the inner side 111 of the securing plate 110. The strut 120 now extends over a final angle 122 of approximately 180°. The clamping region 130 between the inner resilient bars 140 and the outer resilient bars 150 of the first contact bracket 100 is arranged in a direction perpendicular relative to the inner side 111 of the securing plate 110 over the inner side 111 of the securing plate 110 and orientated substantially parallel with the securing plate 110.

The first inner resilient bar 141 is engaged behind the first catch projection 165 of the first wing 160 of the first contact bracket 100. The second inner resilient bar 142 of the first contact bracket 100 is engaged behind the second catch projection 175 on the second wing 170 of the first contact bracket 100. It is thereby ensured that the clamping region 130 between the inner resilient bars 140 and the outer resilient bars 150 of the first contact bracket 100 remains in its end position parallel with the inner side 111 of the securing plate 110 and the strut 120 maintains its final angle 122.

The second contact bracket 200 is bent in a similar manner to the first contact bracket 100.

Figure 4:
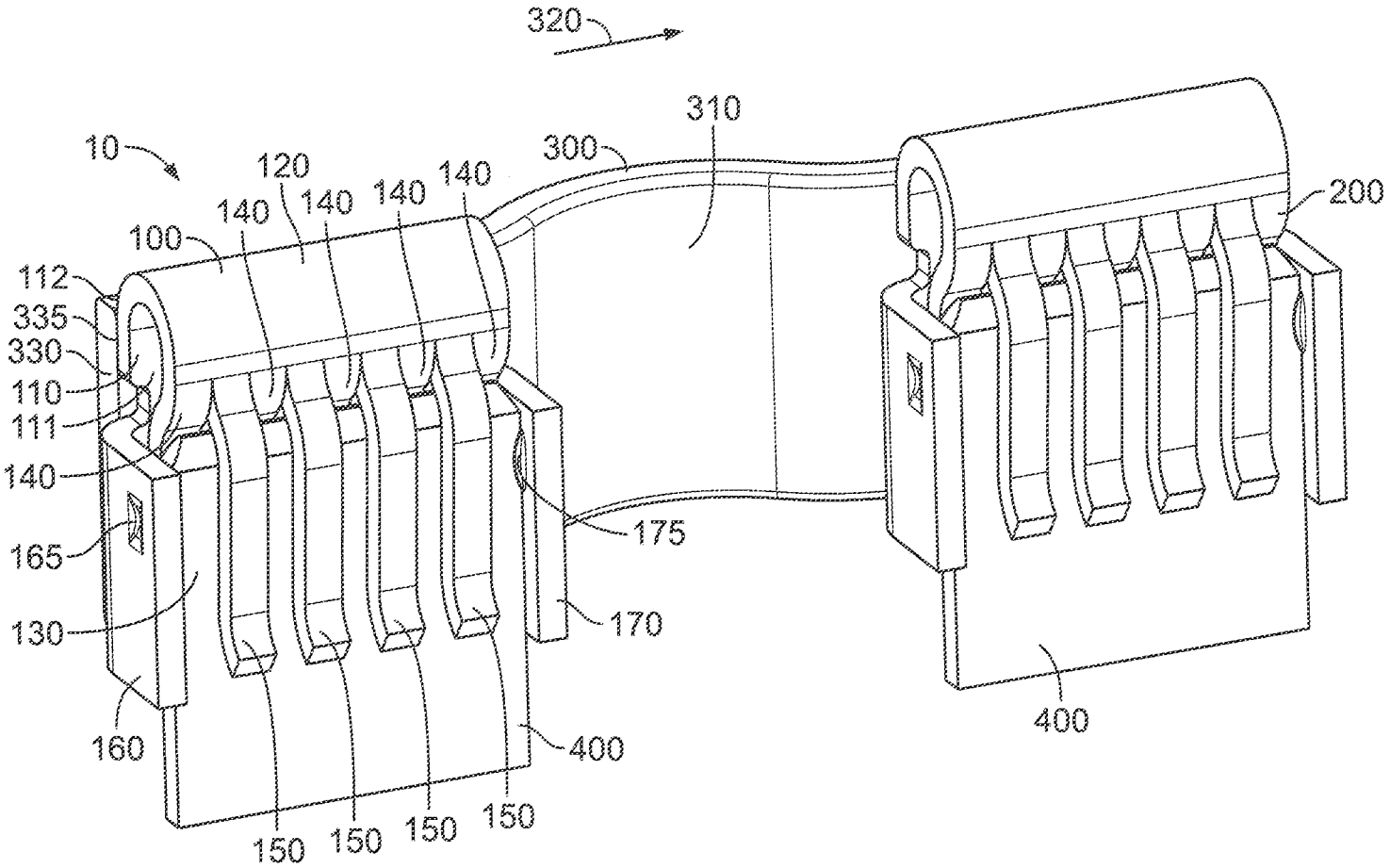
FIG. 4 is a perspective view of the electrical connector having contact blades which are inserted into contact brackets.

FIG. 4 is another perspective view of the electrical connector 100. In the illustration of FIG. 4, two contact blades 400 have been pushed into the clamping region 130 of the first contact bracket 100 and the clamping region 130 of the second contact bracket 200. The contact blades 400 belong to components which are not illustrated in FIG. 4 and which are connected to each other in an electrically conductive manner by means of the electrical connector 10. The components may, for example, be battery modules or battery cells of a motor vehicle having an electrical drive system.

The contact blades 400 have each been inserted into the clamping regions 130 of the contact brackets 100, 200 in a direction orientated parallel with the flat side 310 of the strip 300 and perpendicularly relative to the longitudinal extent direction 320 of the strip 300. In the clamping regions 130, the inner resilient bars 140 and the outer resilient bars 150 apply a resilient clamping force to the contact blades 400, which are thereby retained in the clamping region 130.

There are connections which have good electrical conductivity between the contact blades 400 and the inner resilient bars 140 and outer resilient bars 150 of the contact brackets 100, 200. Via the contact brackets 100, 200 and the metal braiding 300 of the electrical connector 10, the contact blades 400 are connected to each other in an electrically conductive manner.

It is also possible to construct the electrical connector 10 in such a manner that the contact blades 400 can be introduced into the clamping regions 130 of the contact brackets 100, 200 perpendicularly relative to the flat side 310 of the strip 300. The contact brackets 100, 200 do not necessarily have to be arranged at the flat side 310 of the strip 300.

An advantage of the electrical connector 10 is that the electrical connector 10 can be adapted to different spacings between the two contact blades 400. The flexible strip 300 can compensate for a smaller spacing between the contact blades 400 by means of creasing. The contact blades 400 also do not necessarily have to be arranged parallel with each other.

LIST OF REFERENCE NUMERALS

10 Electrical connector
100 First contact bracket
110 Securing plate
111 Inner side
112 Outer side
120 Strut
121 Forward bending angle
122 Final angle
130 Clamping region
140 Inner resilient bars
141 First inner resilient bar
142 Second inner resilient bar
150 Outer resilient bar
160 First wing
165 First catch projection
170 Second wing
175 Second catch projection
200 Second contact bracket
300 Strip
310 Flat side
320 Longitudinal extent direction
330 First longitudinal end
335 First connection
340 Second longitudinal end
345 Second connection
400 Contact blade

The invention claimed is:

1. An electrical connector comprising:
a first single-piece contact bracket,
a second single-piece contact bracket, and
a flat, flexible, electrically conductive strip, wherein the first contact bracket and the second contact bracket are secured to the strip with spacing, wherein at least one of the first and second contact brackets has a plurality of inner resilient bars and a plurality of outer resilient bars which are arranged on a common strut, and a clamping region is formed between the inner resilient bars and the outer resilient bars.

2. The electrical connector of claim 1, wherein the clamping region of at least one of the first and second contact brackets is configured for receiving a contact blade.

3. The electrical connector of claim 2, wherein the first and/or second contact bracket is/are constructed in such a manner that a contact blade can be introduced into the clamping region parallel with a flat side of the strip.

4. The electrical connector of claim 2, wherein the first and/or second contact bracket is/are constructed in such a manner that a contact blade can be introduced into the clamping region perpendicularly relative to a longitudinal extent direction of the strip.

5. The electrical connector of claim 1, wherein the first and/or the second contact bracket has/have a securing plate, wherein the securing plate is secured to the strip.

6. The electrical connector of claim 5, wherein the common strut adjoins the securing plate, and wherein the first and/or second contact bracket is/are angled in the region of the strut in such a manner that the clamping region is arranged above the securing plate and is orientated substantially parallel with the securing plate.

7. The electrical connector of claim 1, wherein the first contact bracket and the second contact bracket are secured to the strip by means of welding, soldering, stapling or riveting.

8. The electrical connector of claim 5, wherein the first and/or second contact bracket has/have a first wing and a second wing, wherein the securing plate is arranged between the first wing and the second wing, wherein the first wing and the second wing are each angled through approximately 90° with respect to the securing plate, wherein the first wing has a first catch projection and the second wing has a second catch projection, wherein two inner resilient bars are engaged on the catch projections.

9. The electrical connector of claim 1, wherein the strip comprises a metal braiding strip, a plurality of parallel layers of thin metal and/or a plurality of metal strips or wires which are arranged beside each other.

10. The electrical connector of claim 1, wherein the first contact bracket and the second contact bracket are secured to a flat side of the strip.

11. The electrical connector of claim 1, wherein the first contact bracket and the second contact bracket are constructed in an identical manner.

12. A method for producing an electrical connector comprising the steps of:
producing a first contact bracket having a securing plate and a plurality of inner resilient bars and a plurality of outer resilient bars by means of punching, wherein the inner resilient bars and the outer resilient bars are connected to the securing plate by means of a strut, wherein a clamping region is formed between the inner resilient bars and the outer resilient bars;
securing the first contact bracket and a similar second contact bracket to a flat, flexible, electrically conductive strip; and
bending the strut of the first contact bracket in such a manner that the clamping region is arranged over the securing plate and is orientated substantially parallel with the securing plate.

13. The method according to claim 12, wherein the strut is bent with respect to the securing plate through a first angle before the first contact bracket is secured, and wherein the strut is bent after the first contact bracket has been secured until the clamping region has reached the end position thereof.

14. The method according to claim 12, wherein the first contact bracket is produced with a first wing and a second wing which are arranged at mutually opposing sides of the securing plate, wherein a first catch projection is constructed on the first wing and a second catch projection is constructed on the second wing, wherein the first wing and the second wing are each angled through approximately 90° with respect to the securing plate, and wherein two inner resilient bars are engaged on the catch projections.

15. An electrical connector comprising:

a first single-piece contact bracket, a second single-piece contact bracket, and a flat, flexible, electrically conductive strip, wherein the first contact bracket and the second contact bracket are secured to the strip with spacing, wherein the first and/or the second contact bracket has/have a securing plate, and the securing plate is secured to the strip, and the first and/or second contact bracket has/have a first wing and a second wing, wherein the securing plate is arranged between the first wing and the second wing, wherein the first wing and the second wing are each angled through approximately 90° with respect to the securing plate, wherein the first wing has a first catch projection and the second wing has a second catch projection, wherein two inner resilient bars are engaged on the catch projections.

* * * * *